US007841874B2

(12) United States Patent
Yan

(10) Patent No.: US 7,841,874 B2
(45) Date of Patent: Nov. 30, 2010

(54) SOCKET PROTECTOR

(75) Inventor: Chun-Xia Yan, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/511,046

(22) Filed: Jul. 28, 2009

(65) Prior Publication Data

US 2010/0273337 A1 Oct. 28, 2010

(30) Foreign Application Priority Data

Apr. 27, 2009 (CN) ..... 2009 10 301873

(51) Int. Cl.
*H01R 13/44* (2006.01)

(52) U.S. Cl. ..... 439/135

(58) Field of Classification Search ..... 439/142, 439/135, 136, 630, 752, 275
See application file for complete search history.

(56) References Cited

U.S. PATENT DOCUMENTS

| | | | | |
|---|---|---|---|---|
| 5,547,388 | A * | 8/1996 | Hill | 439/135 |
| 5,588,853 | A * | 12/1996 | Anthony | 439/136 |
| 7,104,809 | B1 * | 9/2006 | Huang | 439/76.1 |
| 7,572,155 | B2 * | 8/2009 | Elliott et al. | 439/709 |
| 2003/0207601 | A1 * | 11/2003 | Adachi | 439/135 |
| 2005/0184957 | A1 * | 8/2005 | Bricaud et al. | 345/157 |
| 2006/0148287 | A1 * | 7/2006 | Zahnen et al. | 439/135 |

* cited by examiner

*Primary Examiner*—Jean F Duverne
(74) *Attorney, Agent, or Firm*—Frank R. Niranjan

(57) ABSTRACT

A socket protector for fixing a protective cover to a housing includes a connecting member and a receiving groove defined in the housing. The connecting member is connected to the protective cover. The connecting member has an elastic connecting portion defining a restricting hole. A restricting portion is formed in the receiving groove. When the elastic connecting portion resists the restricting portion, the elastic connecting portion deforms to extend the restricting portion through the restricting hole of the elastic connecting portion, thus connecting the protective cover to the housing.

18 Claims, 5 Drawing Sheets

SOCKET PROTECTOR

BACKGROUND

1. Technical Field

The present disclosure relates generally to socket protectors and, more particularly, to a socket protector fixing a protective cover to a housing of an electronic device.

2. Description of Related Art

An electronic device, such as a computer, often has a plurality of sockets for connecting external devices. When the sockets are not being used, dust accumulates therein, resulting in an unstable connection when the socket is in use. Therefore, the electronic device generally has a protective covers to cover the sockets. The protective covers are fixed on the electronic device via socket protectors.

A typical electronic device includes a housing, a protective cover, and a socket protector. The housing includes a first body engaged with a second body. The socket protector includes a connecting member formed on the protective cover, and an assembly groove formed on an edge of the second body. A fixing portion is formed on an end of the connecting member. When the second body engages the first body, the fixing portion is fixed in the assembly groove, so that the protective cover is fixed to the housing.

When the protective cover is assembled to the housing, the first body and the second body are separated, the fixing portion positioned in the assembly groove of the second body, and the first body engages the second body again to fix the fixing portion in the assembly groove. Assembly efficiency of the electronic device is thus compromised.

Therefore, a socket protector which overcomes the described limitations is desired.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
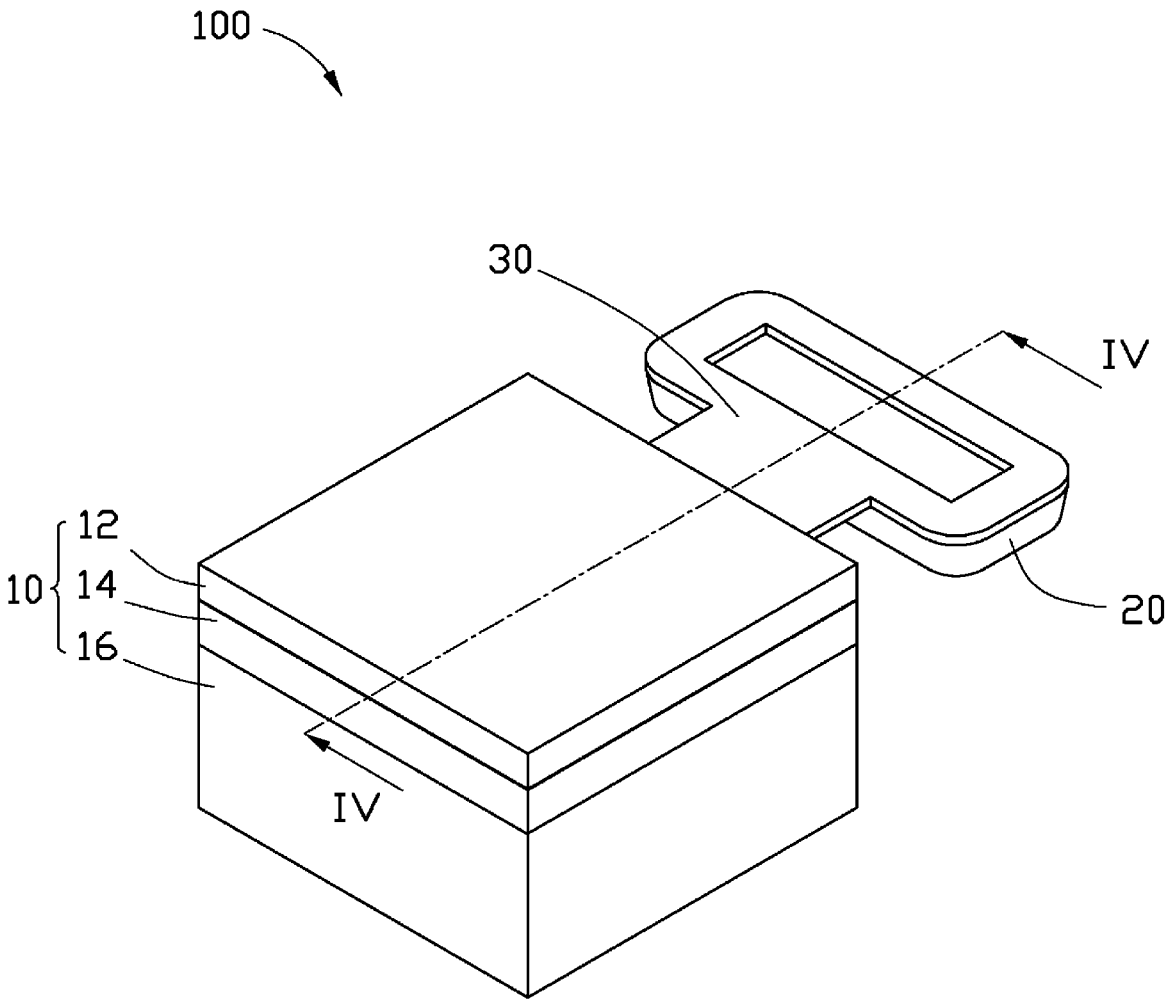
FIG. 1 is an isometric view of an embodiment of an electronic device, including a housing, a connecting member, and a protective cover.
Figure 2:
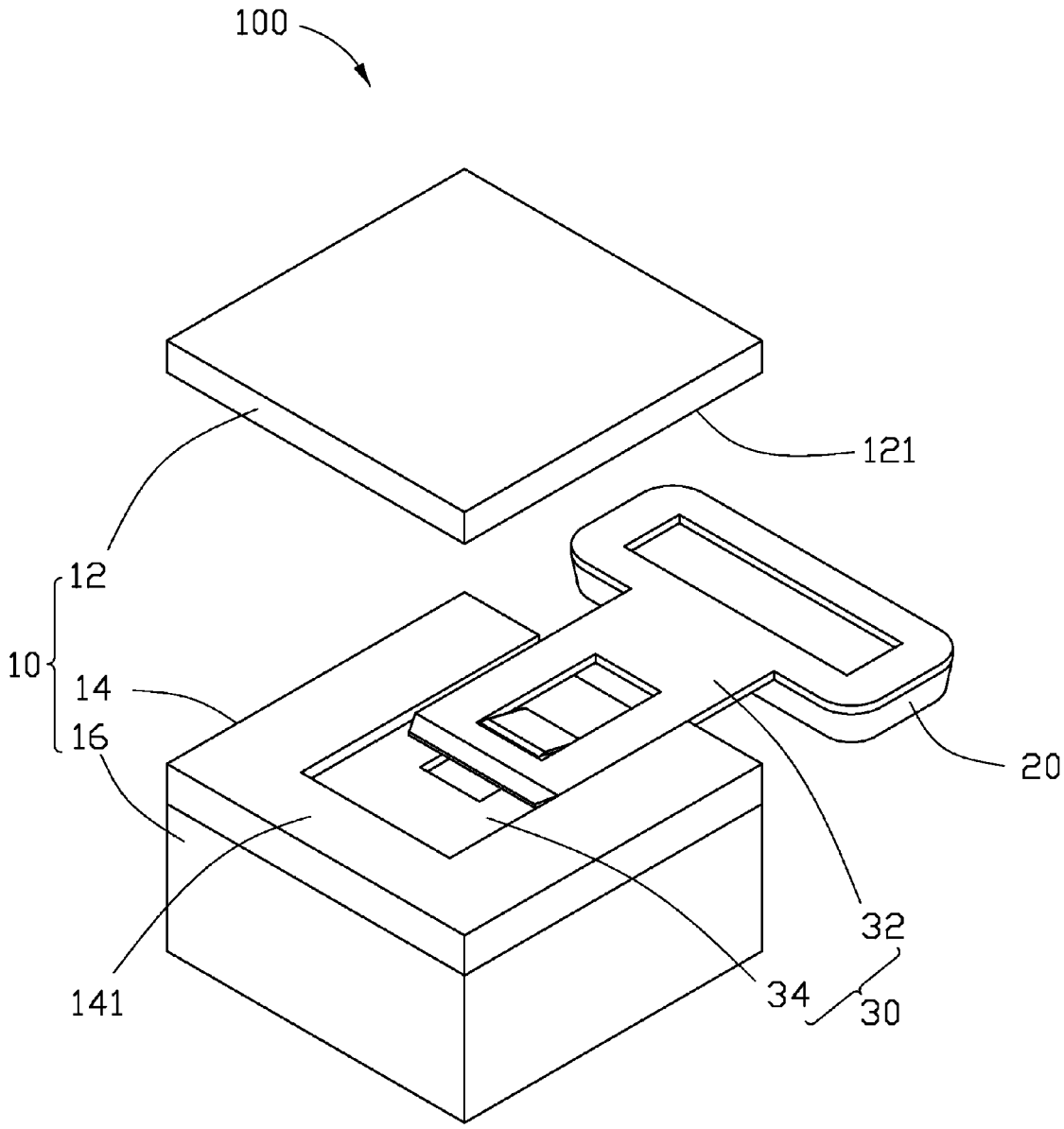
FIG. 2 is an exploded, isometric view of the electronic device of FIG. 1.

Referring to FIGS. 1 and 2, an embodiment of an electronic device 100 includes a housing 10, a protective cover 20, and a socket protector 30 to fix the protective cover 20 to the housing 10.

Figure 3:
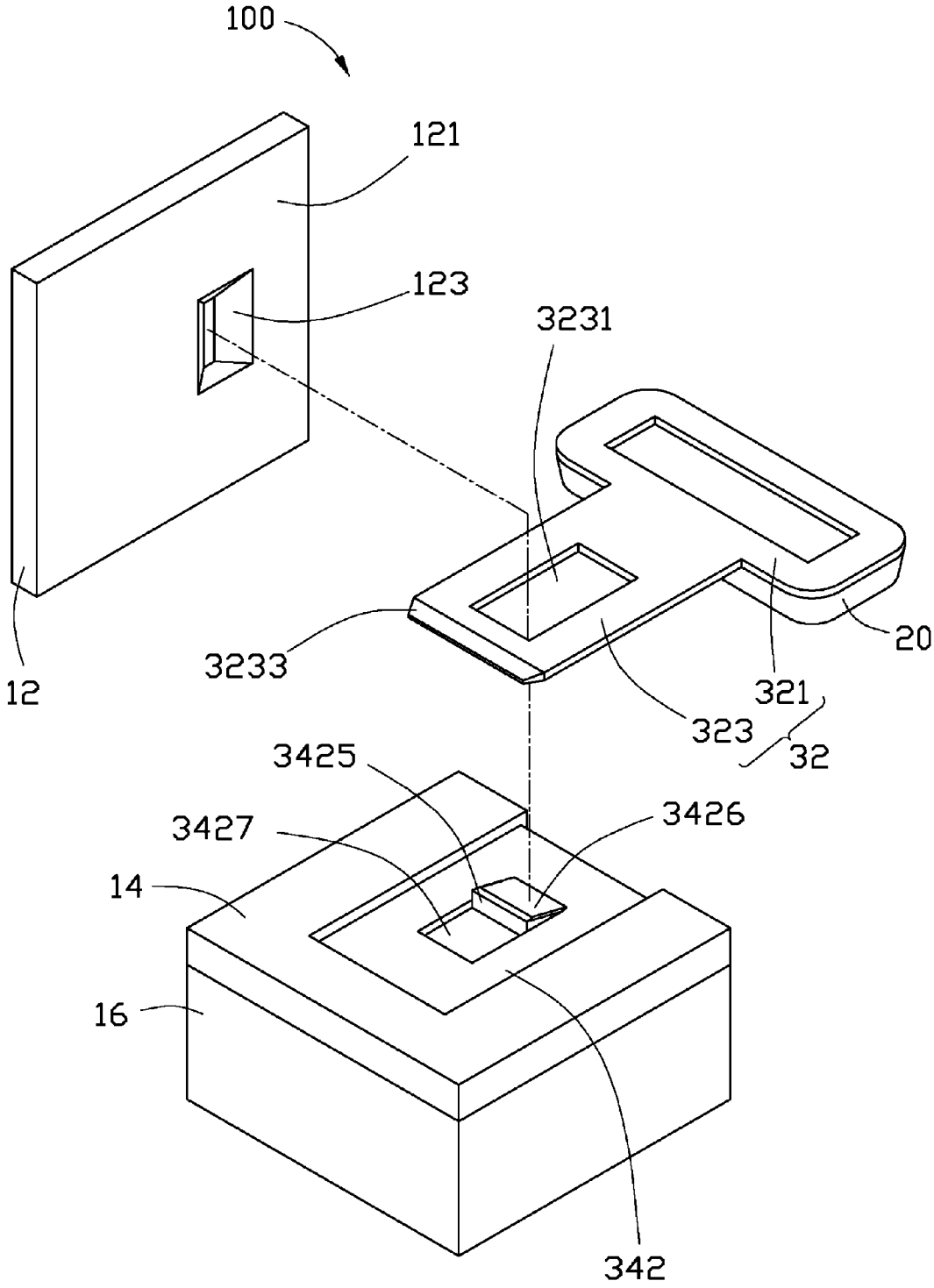
FIG. 3 is another exploded, isometric view of the electronic device of FIG. 1.
Figure 4:
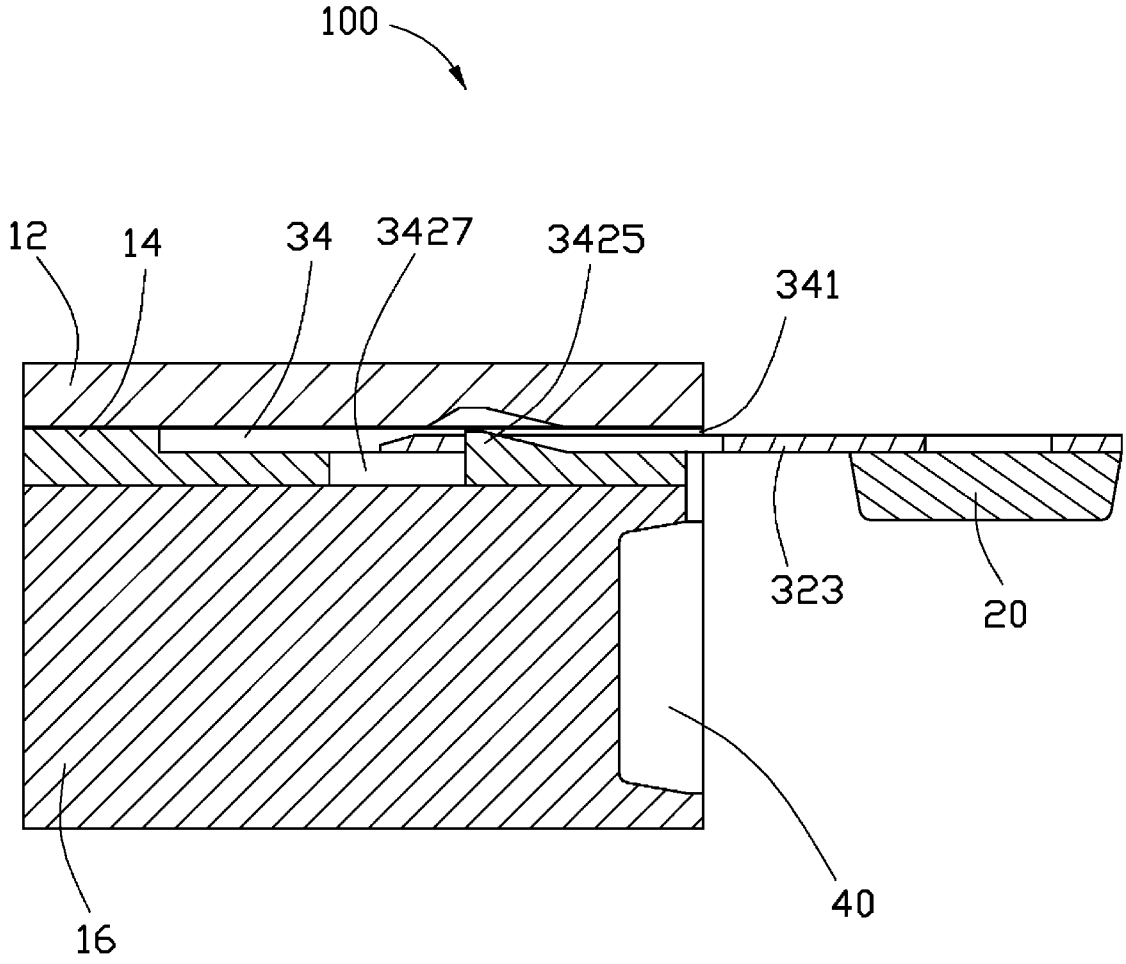
FIG. 4 is a cross-section of the electronic device of FIG. 1 taken along line IV-IV.

The housing 10 includes a first positioning member 12, a second positioning member 14, and a main body 16. The second positioning member 14 is positioned on the main body 16. The first positioning member 12 has a contact surface 121. The first positioning member 12 defines an assembly groove 123 (as shown in FIG. 3) in the contact surface 121. The second positioning member 14 has an assembly surface 141. The main body 16 defines a socket 40 (as shown in FIG. 4) in a side surface. In the illustrated embodiment, the socket 40 is a USB socket for data transmission.

The protective cover 20 is elastic material configured to be received in the socket 40. In the illustrated embodiment, the protective cover 20 is elastic rubber.

The socket protector 30 includes a connecting member 32 and a receiving groove 34 defined in the assembly surface 141 of the second positioning member 14. The connecting member 32 is fixedly connected to the protective cover 20, and can be partially received in the receiving groove 34.

Referring to FIG. 3, the connecting member 32 includes a fixing portion 321 and an elastic connecting portion 323 extending from an end of the fixing portion 321. The fixing portion 321 is fixedly connected to the protective cover 20. The connecting portion 323 is received in the receiving groove 34. The fixing portion 321 is substantially rectangular. A wedge portion 3233 is formed on an end of the connecting portion 323 away from the fixing portion 321. A center of the connecting portion 323 defines a rectangular restricting hole 3231. The connecting portion 323 is elastic material. In the illustrated embodiment, both the connecting portion 323 and the fixing portion 321 are integrally formed by elastic rubber.

A restricting portion 3425 is formed on a middle portion of a positioning wall 342 of the receiving groove 34. A width of the restricting portion 3425 is substantially equal to that of restricting hole 3231, but the length of the restricting portion 3425 is less than that of the restricting hole 3231. Thus, the restricting portion 3425 can be slidably received in the restricting hole 3231 of the connecting portion 323. A sloping surface 3426 is formed on the restricting portion 3425. The positioning wall 342 defines a rectangular connecting hole 3427 adjacent to the restricting portion 3425.

When the first positioning member 12 is fixed to the second positioning member 14, the assembly groove 123 is opposite to the restricting portion 3425, and a space (not labeled) is formed between the restricting portion 3425 and the first positioning member 12. The connecting portion 323 can extend in the space.

Referring to FIG. 4, during assembly of the electronic device 100, the first positioning member 12 is fixed to the second positioning member 14 such that the contact surface 121 contacts the assembly surface 141. Thus, the first positioning member 12 and the second positioning member 14 cooperatively define the receiving groove 34 with an opening 341. The second positioning member 14 is fixed on the main body 16. The connecting portion 323 of the connecting member 32 is received in the receiving groove 34 from the opening 341. When the connecting portion 323 resists the restricting portion 3425, the connecting portion 323 deforms until the restricting portion 3425 engages the restricting hole 3231 of the connecting portion 323. After that, the connecting member 32 is slidably connected to the housing 10.

Figure 5:
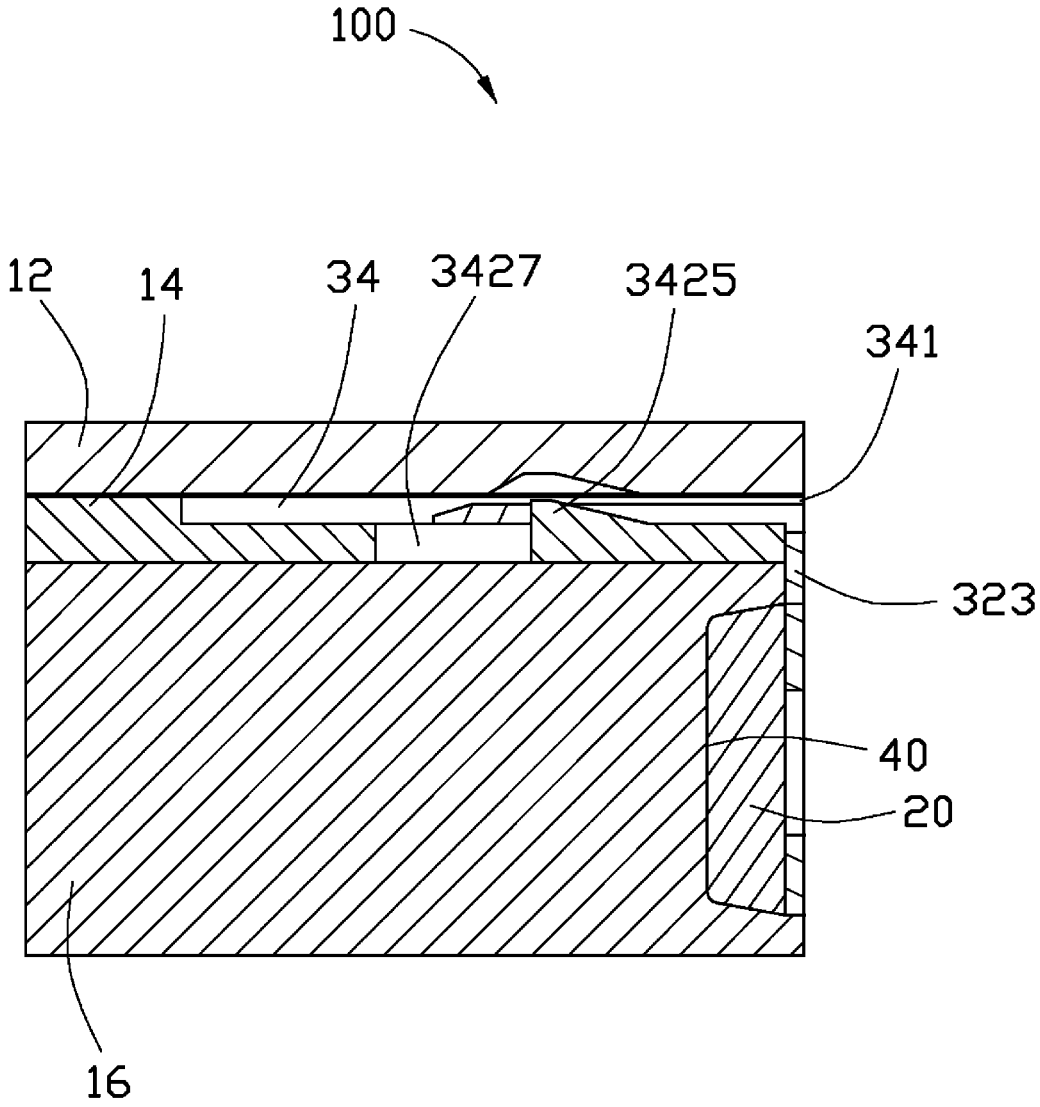
FIG. 5 is similar to FIG. 4, but shows another state.

Referring to FIGS. 4 and 5, in use, the connecting portion 323 is withdrawn from the receiving groove 34, until the restricting portion 3425 resists an end of the restricting hole 3231. The connecting portion 323 is bent, and the protective cover 20 engages the socket 40 of the electronic device 100. When the socket 40 is to be used, the protective cover 20 is withdrawn from the socket 40, and the connecting portion 323 received in the receiving groove 34.

The protective cover 20 is connected to the housing 10 via the connecting member 32. Therefore, there is no need to disassemble the first positioning member 12 from the second positioning member 14, when replacing the protective cover 20. That is, the protective cover 20 needs only be disassembled from the connecting member 32. In addition, the connecting portion 323 can be entirely received in the receiving groove 34 when the protective cover 20 is not used. Thus, the protective cover 20 does not collide with the housing 10.

It should be pointed out that the first positioning member 12, the second positioning member 14, and the main body 16 of the housing 10 can be integrally formed. In such a case, the housing 10 defines a receiving groove for slidably receiving the connecting portion 323 of the connecting member 32.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A socket protector for fixing a protective cover to a housing, comprising:

a receiving groove defined in the housing; and a connecting member connected to the protective cover;

wherein the connecting member has an elastic connecting portion defining a restricting hole, and a restricting portion is formed in the receiving groove;

wherein when the elastic connecting portion resists the restricting portion, the elastic connecting portion deforms to extend the restricting portion through the restricting hole of the elastic connecting portion, thus connecting the protective cover to the housing.

2. The socket protector of claim 1, wherein the housing comprises a first positioning member and a second positioning member, the first positioning member engaging the second positioning member to form the receiving groove.

3. The socket protector of claim 2, wherein the housing further comprises a main body on which the second positioning member is fixed.

4. The socket protector of claim 2, wherein the restricting portion is formed on the second positioning member and the first positioning member defines an assembly groove corresponding to the restricting portion.

5. The socket protector of claim 1, wherein the connecting member further comprises a fixing portion to which the protective cover is fixed.

6. The socket protector of claim 5, wherein a wedge portion is formed on an end of the connecting portion away from the fixing portion.

7. The socket protector of claim 1, wherein a length of the restricting portion is less than that of the restricting hole, such that the protective cover slidably connects to the housing.

8. The socket protector of claim 1, wherein a sloping surface is formed on the restricting portion.

9. The socket protector of claim 1, wherein the connecting portion is elastic rubber.

10. An electronic device, comprising:

a housing defining a socket and a receiving groove adjacent to the socket;

a protective cover engaging in the socket; and a connecting member connected to the protective cover;

wherein the connecting member comprises an elastic connecting portion defining a restricting hole, and a restricting portion is formed in the receiving groove of the housing;

wherein when the elastic connecting portion resists the restricting portion, the elastic connecting portion deforms to extend the restricting portion through the restricting hole of the elastic connecting portion, thus slidably connecting the protective cover to the housing.

11. The electronic device of claim 10, wherein the housing comprises a first positioning member and a second positioning member, and the first positioning member engages the second positioning member to form the receiving groove.

12. The electronic device of claim 11, wherein the housing further comprises a main body on which the second positioning member is fixed.

13. The electronic device of claim 11, wherein the restricting portion is formed on the second positioning member, and the first positioning member defines an assembly groove corresponding to the restricting portion.

14. The electronic device of claim 10, wherein the connecting member further comprises a fixing portion on which the protective cover is fixed.

15. The electronic device of claim 14, wherein a wedge portion is formed on an end of the connecting portion away from the fixing portion.

16. The electronic device of claim 10, wherein a length of the restricting portion is less than that of the restricting hole, thus slidably connecting the protective cover to the housing.

17. The electronic device of claim 10, wherein a sloping surface is formed on the restricting portion.

18. The electronic device of claim 10, wherein the connecting portion is elastic rubber.

* * * * *